US006000726A

United States Patent [19]

Campbell

[11] Patent Number: 6,000,726

[45] Date of Patent: Dec. 14, 1999

[54] MULTI-LAYERED DUAL ADHESIVE LABEL

[76] Inventor: Christopher C. Campbell, 469 Brookhurst Ave., Narberth, Pa. 19072

[21] Appl. No.: 08/718,063

[22] Filed: Sep. 17, 1996

[51] Int. Cl.[6] ..... B42D 15/00

[52] U.S. Cl. ..... 283/81; 283/101; 283/79; 283/105

[58] Field of Search ..... 283/101, 105, 283/81, 79, 80; 40/299, 312, 310, 630; 428/40.1, 43

[56] References Cited

U.S. PATENT DOCUMENTS

| | | | |
|---|---|---|---|
| 4,767,654 | 8/1988 | Riggsbee | 428/40.1 |
| 4,771,891 | 9/1988 | Sorensen et al. | 40/312 |
| 5,172,936 | 12/1992 | Sullivan et al. | 283/81 |
| 5,178,419 | 1/1993 | Bolnick et al. | 283/101 |
| 5,316,344 | 5/1994 | Popat et al. | 283/81 |
| 5,346,739 | 9/1994 | Nassoiy | 283/81 |
| 5,348,780 | 9/1994 | Boggs et al. | 283/81 |
| 5,351,993 | 10/1994 | Wright et al. | 283/79 |
| 5,370,420 | 12/1994 | Khatib et al. | 283/101 |
| 5,380,045 | 1/1995 | Comann | 283/79 |
| 5,413,383 | 5/1995 | Laurash et al. | 283/79 |
| 5,437,477 | 8/1995 | Olivera et al. | 283/81 |
| 5,449,201 | 9/1995 | Miller et al. . | |
| 5,482,753 | 1/1996 | Langan et al. | 428/40.1 |

*Primary Examiner*—Willmon Fridie, Jr.
*Attorney, Agent, or Firm*—Ratner & Presita

[57] ABSTRACT

A multi-layered adhesive label suitable for processing through a laser printer includes a substantially tear resistant layer with a printable layer permanently adhered to one side of the tear resistant layer. An adhesive layer is permanently adhered to the other side of the tear resistant layer. The label can comprise two discrete portions. Each label portion can have a permanent adhesive layer or a non-permanent adhesive layer. Thus, one label portion can be removably adhered to a receiving surface while the other portion is permanently adhered to the same receiving surface.

6 Claims, 1 Drawing Sheet

MULTI-LAYERED DUAL ADHESIVE LABEL

FIELD OF THE INVENTION

The present invention relates generally to adhesive labels, and more specifically to a multi-layered adhesive label having superior tear resistant qualities, while having the capability of better receiving and retaining toner images from a laser printer.

BACKGROUND OF THE INVENTION

Laser printers are particularly well suited for fast, clear printing and provide flexibility in the type and range of images that can be printed. A laser printer generates an image by fusing toner particles to the surface of a sheet material fed into the laser printer. Good and proper fusing requires the sheet material to be receptive to the toner particles. Paper works very well with laser printers, providing a surface which is receptive to and capable of retaining the toner image. The ability of paper to receive and retain toner images from a laser printer is one of the reasons that paper adhesive labels are now commonly printed using laser printers. Another reason is that paper is a cost effective material for making labels. The vast majority of labels are made of a paper/adhesive combination, mounted on a backing sheet and are commonly referred to as pressure sensitive adhesive labels.

To print a pressure sensitive adhesive label with a laser printer, the adhesive label/backing sheet set is fed through a laser printer and a desired image is printed upon the label. After removing the printed label/backing sheet set from the laser printer, the label is applied by first peeling it from the backing sheet and then applying it to a desired location.

Pressure-sensitive labels are well known and commonly used in many applications where it is necessary or desirable to display information. In situations where a label may be exposed to rough handling or the rigors of outdoor climatic/environmental conditions, traditional paper labels are often inadequate. These types of demanding conditions are common in the chemical industry where chemicals are stored and transported in large bulk containers. These bulk containers are often stored outdoors or exposed to outdoor conditions in areas where weathering and abrasions from handling and storage can damage a label that is adhered to the containers.

Many durable materials that do not deteriorate under these conditions are poorly suited for receiving and retaining images from laser printers. Materials such as polymer films are sufficiently durable to endure the weathering and abrasion, but are generally, not well suited for accepting the toner images produced by laser printers. Films which are suitable for laser printing are typically expensive and thus prohibitive for use in applications where cost is a factor in label selection. In many high volume applications, such as the distribution of chemicals, even relatively small differences in price per label can translate into significant amounts of money when multiplied by the large numbers of labels used. Therefore, labels consisting essentially of these films are generally, not desirable where durable and inexpensive labels are required.

It is also common in some industries to sell identical products under various names to different customers or to different industries. The reason for selling identical products under different names may relate to marketing purposes of the manufacturer or supplying products to the original equipment manufacturer (OEM) market where the purchaser applies its own brand name or trademark to the product.

In the chemical field, when an identical chemical is sold under several different names or trademarks, the hazard warnings and properties of the chemicals sold under the different names or trademarks remains the same. In these situations, each package for the chemical, regardless of the difference in name or trademark under which it is being sold, still requires the same hazard warning and listing of the chemical properties. Particularly when dealing with bulk chemicals which are packaged in large containers or drums, the realities of inventory control may result in insufficient quantities of product labeled with each different name or trademark. In these situations, since the underlying chemicals are identical to the chemicals packaged in containers with merely a different name or trademark, it is common to re-label the containers to display the desired name.

The labels applied to the packaging for bulk chemical products are usually a single label containing the name of the product, the hazard warning and/or the chemical properties of the chemical. Relabeling of the packaging for bulk chemical products requires removal of the entire label and replacing it with a new label or applying a new label over top of the old label (over-labeling). Removal of the entire label is time consuming and, therefore, more expensive, because of the strong adhesives normally used. Because warning labels are usually used with chemical products, it is important to use a strong adhesive to ensure that the warning label and product safety information stay on the container. Removing an existing label to replace it with a new label also raises the possibility that the new label may be inadvertently left off, creating a potentially hazardous condition.

Over labeling is also not desirable because it is possible that the user will peel off the new label, revealing the name or trademark shown on the original label and possibly the name of the chemical product as it is sold to other customers or industries. Over-labeling may also result in a poor appearance if the new label is not a perfect match, properly positioned over the old label.

Since not every situation will require a second label with a different product name, it is efficient and effective to print the original label as a single label containing the intended name of the product and the hazard warning/chemical property information. Printing a single label helps insure that each product package or container receives both the hazard warning/chemical property information and the name of the product. It is very important that the hazard warning/chemical property information is permanently adhered to the containers from the beginning, in case of an emergency. Having the name and warning information printed on a single label will also help avoid confusion and mislabeling.

SUMMARY OF THE INVENTION

The present invention provides an adhesive label having a substantially tear resistant layer. A printable layer is permanently adhered to one side of the tear resistant layer and an adhesive layer is permanently adhered to the opposite side of the tear resistant layer. In this configuration, the label has the tear resistant qualities of the tear resistant layer and the laser printer toner receptive qualities of the printable layer. In an exemplary embodiment, the tear resistant layer is a laminate film.

An additional embodiment of the present invention provides an adhesive label having first and second label portions. Each label portion comprises a substantially tear resistant layer, a printable layer permanently adhered to one side of the tear resistant layer, and an adhesive layer permanently adhered to the opposite side of the tear resistant layer. The adhesive layer of one of the label portions contains a permanent adhesive. the adhesive layer of the other label portion contains a non-permanent adhesive. The two label portions are removably attached to each other, allowing later separation, after application.

BRIEF DESCRIPTION OF THE DRAWINGS

The present invention will now be described by way of non-limiting examples, with reference to the attached drawings in which.

DETAILED DESCRIPTION

Figure 1:
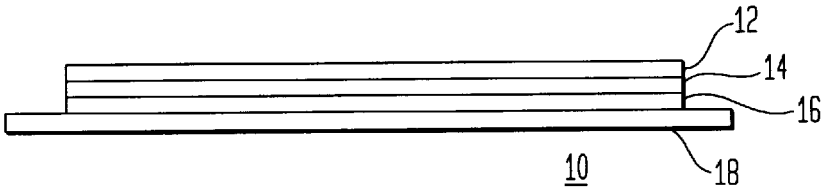
FIG. 1 is a cross section of an adhesive label in accordance with an embodiment of the present invention.

There is shown in FIG. 1 a cross section of an adhesive label 10. Adhesive label 10 is comprised of a substantially tear resistant (or reinforced) layer 14 having first and second surfaces. A printable (or facestock) layer 12 is permanently adhered to the first surface of tear resistant layer 14. An adhesive layer 16 is permanently adhered to the second surface of tear resistant layer 14. This particular multi-layered construction of adhesive label 10 provides a substantially tear resistant adhesive label capable of receiving and retaining images on the non-adhesive, exposed surface, such as those images generated by a laser printer.

Substantially tear resistant layer 14 as described herein includes materials resistant, but not necessarily impervious, to tearing when subjected to shear stress across the layer or other stresses inherent in a tearing or ripping motion. This layer acts as a reinforcement for label 10. In an exemplary embodiment, substantially tear resistant layer 14 is comprised of a clear biaxially oriented polypropylene (BOPP) pressure sensitive laminated film, approximately 1 millimeter thick. The adhesion of the BOPP film is approximately 20 ounces per inch and the tensile strength is approximately 20 pounds per inch. The exemplary BOPP film can elongate to approximately 110% at break. The exemplary BOPP film is laminated to printable layer 12 using a pressure sensitive adhesive. In an alternative embodiment, substantially tear resistant layer 14 is applied as a liquid film coating to form a laminate with printable layer 12.

Printable layer 12 as described herein includes layers comprising materials capable of receiving images from a laser printer and retaining these images in a non-transient manner for a significant period of time suitable for the desired use of the label. Printable layer 12 can be chosen from materials with surfaces that are receptive to fusing with the toner images generated by a laser printer or similar type printer. Examples of materials with the desired printable qualities include paper. In an exemplary embodiment, printable layer 12 is comprised of a facestock uncoated laser imprintable paper, such as a 51 pound laser copy sheet such as that supplied by Gladfelder paper under its product number G-SRS 51# 83160-D30.

Adhesive layer 16 as used in accordance with the present invention includes layers comprising a permanent adhesive or a non-permanent adhesive. The adhesives used can be of various types which can withstand the heat generated by a laser printer. Examples include acrylic emulsion pressure-sensitive adhesives or some hot melt adhesives, which are commercially available and which have the ability to withstand the heat of a laser printer.

Non-permanent adhesives include adhesives which, when used in the context of the present invention, allow label 10 or a portion thereof, to be removed from a receiving surface without undue dfficulty. A non permanent adhesive layer should be capable of adhering to various surfaces to which the label may be applied, such as steel, fiber and plastic drums. Commercially available, removable adhesives able to withstand the heat generated by the fusing process of a laser printer are known by those skilled in the art. In an exemplary embodiment, an acrylic emulsion pressure sensitive adhesive is used as a non-permanent adhesive layer.

Permanent adhesives include adhesives which, when used in the context of the present invention, allow the label to adhere to a receiving surface with such tenacity that removal without de-laminating the label is difficult. A permanent adhesive layer is capable of adhering to various surfaces such as steel, fiber and plastic drums. In an exemplary embodiment, a commercially available, permanent adhesive able to withstand the heat generated by the fusing process of a laser printer, known by those skilled in the art, is used as a permanent adhesive layer.

Figure 3:
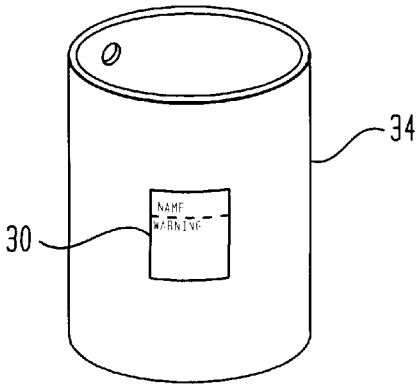
FIG. 3 shows an adhesive label in accordance with the present invention attached to a container.

Both adhesive layer 16 and printable layer 12 are permanently adhered to respective surfaces of substantially tear resistant layer 14. That is, adhesive layer 14 and printable layer 12 are not merely temporarily disposed on substantially tear resistant layer 14, but are bonded together to form a composite label construction capable of retaining its substantially uniform composite structure after it is adhered to a receiving surface. The term receiving surface includes any surface capable of any appreciable degree of bonding with adhesive layer 16. Examples of receiving surfaces include metals, plastics, woods, cardboard, and glass. In an exemplary embodiment, label 10 is adhered to a chemical container such as chemical drum 34 shown in FIG. 3.

Adhesive label can be provided with a release liner 18, removably attached to the back of adhesive layer 16. Release liner 18 should be capable of allowing removal of label 10 from release liner 18 for application to a surface, regardless of the adhesive 16 used with label 10. In an exemplary embodiment, release liner 18 is a 50 pound bleach super-calendered kraft (S2S) base sheet, silicone coated on one side using an addition cured release system. Other commercially available release liners known to be compatible with laser printers are known by those skilled in the art. In an exemplary embodiment, release liner 18 is an 8½ inch×11 inch sheet for ease of operation with a laser printer. Also in an exemplary embodiment, label 10 is slightly smaller than the 8½ inch×11 inch release liner 18 to assist in removal of label 10 from release liner 18. Label 10 can be sized, however, as desired.

Figure 2:
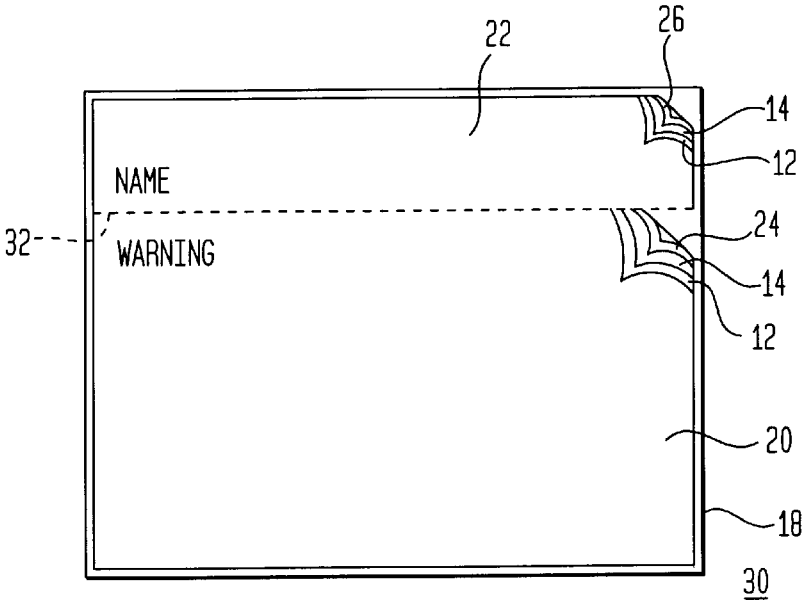
FIG. 2 is a top view of an adhesive label in accordance with one embodiment of the present invention.

Adhesive label 10 can be preprinted with text (not shown), prior to passing through a laser printer for application specific printing. For example, the company which is manufacturing the products may choose to have its name and logo printed on each label 10 (or label 30 as shown in FIG. 2) in the company colors. In climatic environmental conditions fade resistance is desirable. Inks such as the 4000 Series inks from the Werneke company are used for such a purpose in an exemplary embodiment of the present invention.

As shown in FIG. 2, adhesive label 30 of the present invention comprises two discrete label portions, namely first label portion 20 and second label portion 22. Each label portion comprises a substantially tear resistant layer 14 having first and second surfaces. A printable layer 12 is permanently adhered to one surface of the respective tear resistant layer 14 An adhesive layer 16 is permanently adhered to the second surface of tear resistant layer 14. In an exemplary embodiment, first label portion 20 includes a permanent adhesive layer 24, permanently adhered to the second surface of tear resistant layer 14, and second label portion 22 includes a non-permanent adhesive layer 26, permanently adhered to the second surface of tear resistant layer 14. Label 30 is mounted on a release liner 18.

In an exemplary embodiment, release liner 18 is an 8½ inch×11 inch sheet. Label 30 is slightly smaller than release liner 18 to allow ease of removal of label 30. First label portion 20, having permanent adhesive 24, is designed to contain hazard warning and/or chemical property information when used with chemical storage containers. In this way the necessary information is permanently attached to and present with the container holding the chemical. Second label portion 22, having non-permanent adhesive 26, is designed to contain the name or trademark of the chemical.

Label 30 is also shown with removable attachment means 32 to allow detachment of the first label portion 20 from the second label portion 22. Removable attachment means 32 can be of various types understood by those skilled in the art, such as a semi cut of label 30 or various forms of perforations. In an exemplary embodiment, removable attachment means 32 includes a line of circular perforations along the boundary between first label portion 20 and second label portion 22, that allow ease of removal of second label portion 22 from first label portion 20 after application of label 30 to a surface. Removable attachment means 32 allows adhesive label 30 to be passed through a laser printer as a single unit and applied to a receiving surface as a single unit.

If it is desired to change the information on second label portion 22, a user can accomplish this task by removing the existing second label portion 22 from the surface to which it is applied and replacing it with a new second label portion 22, containing the new information. In the example of a chemical drum containing chemicals which are sold under more than one name, a second complete label 30 can be printed with the new name printed in second label portion 22. Printing an entire new label 30 allows the user to also compare the hazard warning/chemical property information against that already adhered to the chemical drum when the original label was applied. If the information is the same, the user peels off the original second label portion 22 and replaces it with the new second label portion 22. In this way, the chemical drum will have one set of accurate labeling—the name of the chemical product and the appropriate hazard warning/chemical property information.

In another embodiment, it may be desirable to have both first label portion 20 and second label portion 22 include a non-permanent adhesive, so that either portion can be replaced at a later time.

The present invention has been described in terms of exemplary embodiments. It is contemplated, however, that it may be practiced with modifications, some of which are outlined above, within the scope of the appended claims. Further modifications and equivalents of the invention herein disclosed will occur to persons skilled in the art using no more than routine experimentation, and all such modifications and equivalents are believed to be within the spirit and scope of the invention as defined by the following claims.

What is claimed:

1. An adhesive label comprising:

a) a first label portion comprising:
- i) a substantially tear resistant layer having first and second surfaces,
- ii) a printable layer permanently adhered to said first surface of said tear resistant layer, and
- iii) an adhesive layer permanently adhered to said second surface of said tear resistant layer; and b) a second label portion comprising:
- i) a substantially tear resistant layer having first and second surfaces;
- ii) a printable layer permanently adhered to said first surface of said tear resistant layer; and
- iii) an adhesive layer permanently adhered to said second surface of said tear resistant layer.

2. An adhesive label as claimed in claim 1, further comprising removable attachment means for detaching said first label portion from said second label portion.

3. An adhesive label as claimed in claim 2, wherein said removable attachment means comprises a line of perforations.

4. An adhesive label as claimed in claim 1, further comprising a release liner having first and second surfaces, at least one of said surfaces having a release coating thereon and removably attached to said adhesive layers of said first and second label portions.

5. An adhesive label for receiving and retaining toner images from a laser printer, said adhesive label comprising:

a) a first label portion comprising:
- i) a tear resistant layer having first and second surfaces,
- ii) a printable layer adapted to receive toner images from a laser printer, said printable layer permanently adhered to said first surface of said tear resistant layer, and
- iii) a permanent adhesive layer permanently adhered to said second surface of said tear resistant layer;

b) a second label portion attached to said first label portion comprising:
- i) a tear resistant layer having first and second surfaces,
- ii) a printable layer adapted to receive toner images from a laser printer, said printable layer permanently adhered to said first surface of said tear resistant layer, and
- iii) a non-permanent adhesive layer permanently adhered to said second surface of said tear resistant layer;

c) at least one line of perforations between said first label portion and said second label portion for detaching said first label portion from said second label portion; and d) a release liner having first and second surfaces, at least one of said surfaces having a release coating thereon, and removably attached to said permanent adhesive layer and to said non-permanent adhesive layer.

6. An adhesive labeling system comprising:

a) a first label portion comprising:
- i) a tear resistant layer having first and second surfaces,
- ii) a printable layer adapted to receive toner images from a laser printer, said printable layer permanently adhered to said first surface of said tear resistant layer, and
- iii) a permanent adhesive layer permanently adhered to said second surface of said tear resistant layer;

b) a second label portion attached to said first label portion comprising:

i) a tear resistant layer having first and second surfaces, ii) a printable layer adapted to receive toner images from a laser printer, said printable layer permanently adhered to said first surface of said tear resistant layer, and iii) a non-permanent adhesive layer permanently adhered to said second surface of said tear resistant layer;

c) at least one line of perforations between said first label portion and said second label portion for detaching said first label portion from said second label portion; and d) a surface to which said first label portion and said second label portion are adhered.

* * * * *